US011522282B2

(12) United States Patent
Song et al.

(10) Patent No.: US 11,522,282 B2
(45) Date of Patent: Dec. 6, 2022

(54) MULTI-ANTENNA GROUND PLANE STRUCTURE FOR INTEGRATION IN A VEHICLE

(71) Applicant: GM Global Technology Operations LLC, Detroit, MI (US)

(72) Inventors: Hyok Jae Song, Oak Park, CA (US); Hanseung Lee, Thousand Oaks, CA (US); Nahel Eshaq, Rochester, MI (US); Gregg R. Kittinger, Oakland, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 25 days.

(21) Appl. No.: 17/200,208

(22) Filed: Mar. 12, 2021

(65) Prior Publication Data

US 2022/0294105 A1 Sep. 15, 2022

(51) Int. Cl.
*H01Q 1/32* (2006.01)
*H01Q 1/48* (2006.01)

(52) U.S. Cl.
CPC ..... *H01Q 1/48* (2013.01); *H01Q 1/3291* (2013.01)

(58) Field of Classification Search
CPC ..... H01Q 1/32; H01Q 1/48; H01Q 9/0407; H01Q 1/24
See application file for complete search history.

(56) References Cited

U.S. PATENT DOCUMENTS

| | | | | |
|---|---|---|---|---|
| 10,186,763 | B2 * | 1/2019 | Niihara | H01Q 1/38 |
| 10,199,721 | B2 * | 2/2019 | Suffolk | H01Q 9/40 |
| 2004/0169608 | A1 * | 9/2004 | Sampo | H01Q 9/42 343/711 |
| 2022/0052447 | A1 * | 2/2022 | Imamura | H01Q 1/3275 |

OTHER PUBLICATIONS

Kwon et al., "A Fully Integrated Shark-Fin Antenna for MIMO-LTE, GPS, WLAN, and WAVE Applications", IEEE Antennas and Wireless Propagation Letters, vol. 17, No. 4, Apr. 2018, pp. 600-603.

Low et al., "Hidden Automotive Antenna Performance and Simulation", IEEE Transactions on Antennas and Propagation, vol. 54, No. 12, Dec. 2006, pp. 3707-3712.

* cited by examiner

*Primary Examiner* — Hasan Islam
(74) *Attorney, Agent, or Firm* — Cantor Colburn LLP

(57) ABSTRACT

A multi-antenna ground plane structure in a vehicle includes a first ground plane to be electrically connected to a fascia chassis. The fascia chassis is a portion of the vehicle covered by a fascia. A first side of the first ground plane seats two or more antennas. The multi-antenna ground plane structure also includes one or more additional ground planes affixed to a second side, opposite the first side, of the first ground plane. One of the one or more additional ground planes is attached to one or more antennas such that the one or more antennas is oriented opposite an orientation of the two or more antennas seated on the first ground plane.

20 Claims, 3 Drawing Sheets

MULTI-ANTENNA GROUND PLANE STRUCTURE FOR INTEGRATION IN A VEHICLE

INTRODUCTION

The subject disclosure relates to a multi-antenna ground plane structure for integration in a vehicle.

Vehicles increasingly include communication devices with transmission and/or reception capability. Each of these devices has one or more corresponding antennas. Exemplary devices include a global navigation satellite system (GNSS) such as the global positioning system (GPS) with antennas in the L1 and/or L5 bands, a satellite radio system (e.g., Sirius Satellite Radio®) and a vehicle-to-everything (V2X) system that facilitates vehicle-to-vehicle (V2V) or vehicle-to-infrastructure (V2I) communication, for example. Accordingly, it is desirable to provide a multi-antenna ground plane structure for integration in a vehicle.

SUMMARY

In one exemplary embodiment, a multi-antenna ground plane structure in a vehicle includes a first ground plane to be electrically connected to a fascia chassis. The fascia chassis is a portion of the vehicle covered by a fascia. A first side of the first ground plane is configured to seat two or more antennas. The multi-antenna ground plane structure also includes one or more additional ground planes affixed to a second side, opposite the first side, of the first ground plane. One of the one or more additional ground planes is attached to one or more antennas such that the one or more antennas is oriented opposite an orientation of the two or more antennas seated on the first ground plane.

In addition to one or more of the features described herein, the multi-antenna ground plane structure is shaped and sized to fit completely within a volume defined by the fascia.

In addition to one or more of the features described herein, the fascia is a spoiler.

In addition to one or more of the features described herein, the first ground plane is affixed to the fascia chassis.

In addition to one or more of the features described herein, the first ground plane is electrically connected to the fascia chassis via copper tape.

In addition to one or more of the features described herein, the first ground plane seats a global navigation satellite system (GNSS) antenna and a satellite radio antenna.

In addition to one or more of the features described herein, the second ground plane is attached to a vehicle-to-everything (V2X) antenna.

In addition to one or more of the features described herein, a shape of the first ground plane is non-uniform in a first dimension along a second dimension that is perpendicular to the first dimension.

In addition to one or more of the features described herein, the one of the one or more additional ground planes is separated from the first ground plane by one or more standoff structures that electrically connect the first ground plane to the one of the one or more additional ground planes.

In addition to one or more of the features described herein, the one or more standoff structures is an aluminum post.

In another exemplary embodiment, a method of fabricating a multi-antenna ground plane structure includes fabricating a first ground plane to be electrically connected to a fascia chassis. The fascia chassis being a portion of the vehicle covered by a fascia, wherein a first side of the first ground plane seats two or more antennas. The method also includes affixing one or more additional ground planes to a second side, opposite the first side, of the first ground plane. One of the one or more additional ground planes is attached to one or more antennas such that the one or more antennas is oriented opposite an orientation of the two or more antennas seated on the first ground plane.

In addition to one or more of the features described herein, the fabricating includes shaping and sizing the multi-antenna ground plane structure to fit completely within a volume defined by the fascia.

In addition to one or more of the features described herein, the fascia is a spoiler.

In addition to one or more of the features described herein, the fabricating includes configuring the first ground plane to be affixed to the fascia chassis.

In addition to one or more of the features described herein, the fabricating includes configuring the first ground plane to be electrically connected to the fascia chassis via copper tape.

In addition to one or more of the features described herein, the fabricating includes configuring the first ground plane to seat a global navigation satellite system (GNSS) antenna and a satellite radio antenna.

In addition to one or more of the features described herein, the method also includes configuring the second ground plane to be attached to a vehicle-to-everything (V2X) antenna.

In addition to one or more of the features described herein, the fabricating includes shaping the first ground plane to be non-uniform in a first dimension along a second dimension that is perpendicular to the first dimension.

In addition to one or more of the features described herein, the method also includes separating the one of the one or more additional ground planes from the first ground plane using one or more standoff structures that electrically connect the first ground plane to the one of the one or more additional ground planes.

In addition to one or more of the features described herein, the one or more standoff structures is an aluminum post.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
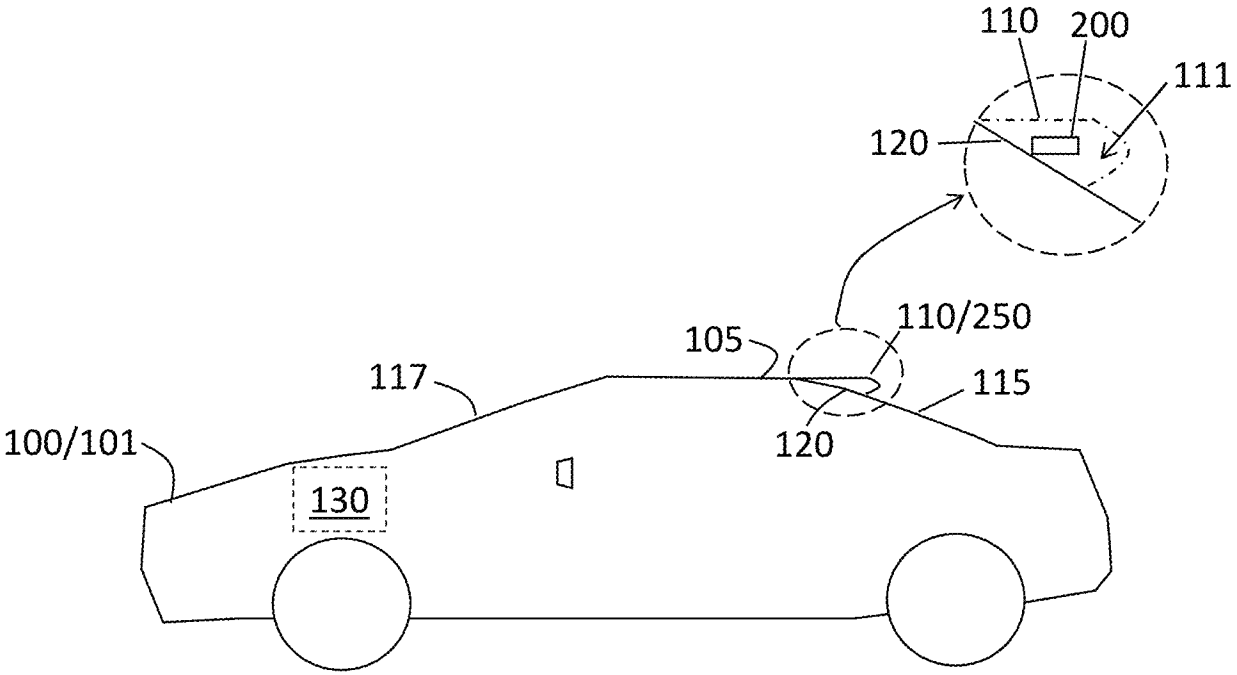
FIG. 1 is a block diagram of a vehicle that includes a multi-antenna ground plane structure for integration within the vehicle.

The following description is merely exemplary in nature and is not intended to limit the present disclosure, its application or uses. It should be understood that throughout the drawings, corresponding reference numerals indicate like or corresponding parts and features.

As previously noted, a vehicle may include a number of communication devices and corresponding antennas. It may be desirable to integrate these antennas in the vehicle in a way that they are hidden rather than protruding from the surface of the vehicle, for aesthetic, aerodynamic, or other purposes. Embodiments of the systems and methods detailed herein relate to a multi-antenna ground plane structure for integration in a vehicle. The ground plane structure is sized and shaped to accommodate antennas that require isolation from each other while fitting completely within the vehicle (e.g., within a volume defined by a spoiler). While a spoiler and corresponding spoiler chassis (i.e., vehicle frame covered by the spoiler) are specifically illustrated and discussed for explanatory purposes, the multi-antenna ground plane structure may be integrated within any fascia of the vehicle and electrically connected to another chassis that is covered by the fascia.

In accordance with an exemplary embodiment, FIG. 1 is a block diagram of a vehicle 100 that includes a multi-antenna ground plane structure 200 for integration within the vehicle 100. The exemplary vehicle 100 shown in FIG. 1 is an automobile 101. In alternate embodiments. the vehicle 100 may be a pick-up truck, sport utility vehicle, or another type of vehicle. The vehicle 100 is shown with a spoiler 110 at the rear edge of the roof 105. The spoiler 110 is an example of fascia 250 affixed on a portion of the vehicle chassis, generally as an aesthetic part of the vehicle 100. The exemplary spoiler 110 is between the roof 105 and the rear windshield 115, as shown. In alternate embodiments, the multi-antenna ground plane structure 200 may be located within a volume defined by other fascia 250 of the vehicle 100. The vehicle 100 includes a spoiler chassis 120, which is a part of the vehicle frame that acts as a structural support for the spoiler 110 and is also the part of the vehicle that is covered by the spoiler 110. The spoiler chassis 120 is metal and is a sloped transition between the roof 105 and the rear windshield 115, as shown. An expanded view of the spoiler 110 and spoiler chassis 120 is shown.

As further discussed with reference to FIG. 2, a multi-antenna ground plane structure 200 is electrically connected to the metal spoiler chassis 120 and is affixed entirely within a volume 111 that is defined by the spoiler 110. The multi-antenna ground plane structure 200 may be affixed to a portion of the spoiler 110 or other fascia 250 (FIG. 2) and electrically connected to spoiler chassis 120 or, more generally, fascia chassis 255 (FIG. 2) by copper tape 204 (FIG. 2) or may be directly fastened to the spoiler chassis 120. The vehicle 100 may include additional components (e.g., sensors, displays) such as a controller 130 to facilitate operation of the devices (e.g., GNSS system, satellite radio) that use antennas 220 mounted on the multi-antenna ground plane structure 200. The controller 130 may include processing circuitry that may include an application specific integrated circuit (ASIC), an electronic circuit, a processor (shared, dedicated, or group) and memory that executes one or more software or firmware programs, a combinational logic circuit, and/or other suitable components that provide the described functionality.

Figure 2:
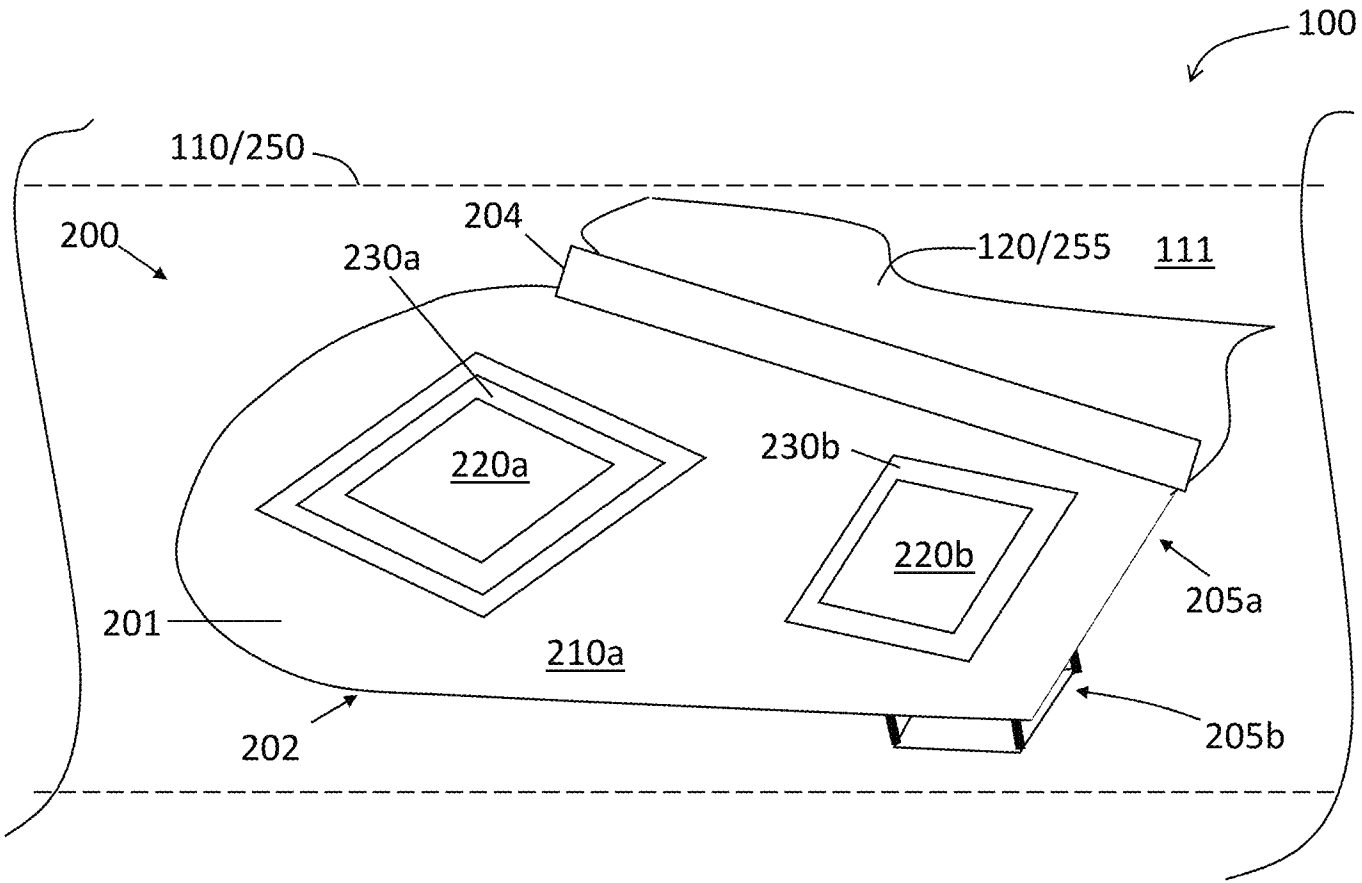
FIG. 2 details aspects of an exemplary multi-antenna ground plane structure for integration within a vehicle according to one or more embodiments.

FIG. 2 details aspects of the multi-antenna ground plane structure 200 for integration within a vehicle 100 according to one or more embodiments. As indicated in the expanded view of FIG. 1, the multi-antenna ground plane structure 200 is entirely within the volume 111 defined by the spoiler 110 and is affixed to the spoiler chassis 120. That is, no portion of the multi-antenna ground plane structure 200 (including the antennas 220) protrudes from the surface of the vehicle 100. As previously noted, the volume 111 within which the multi-antenna ground plane structure 200 is confined may be defined by another fascia 250 that covers, generally, a fascia chassis 255 of the vehicle 100.

Figure 3:
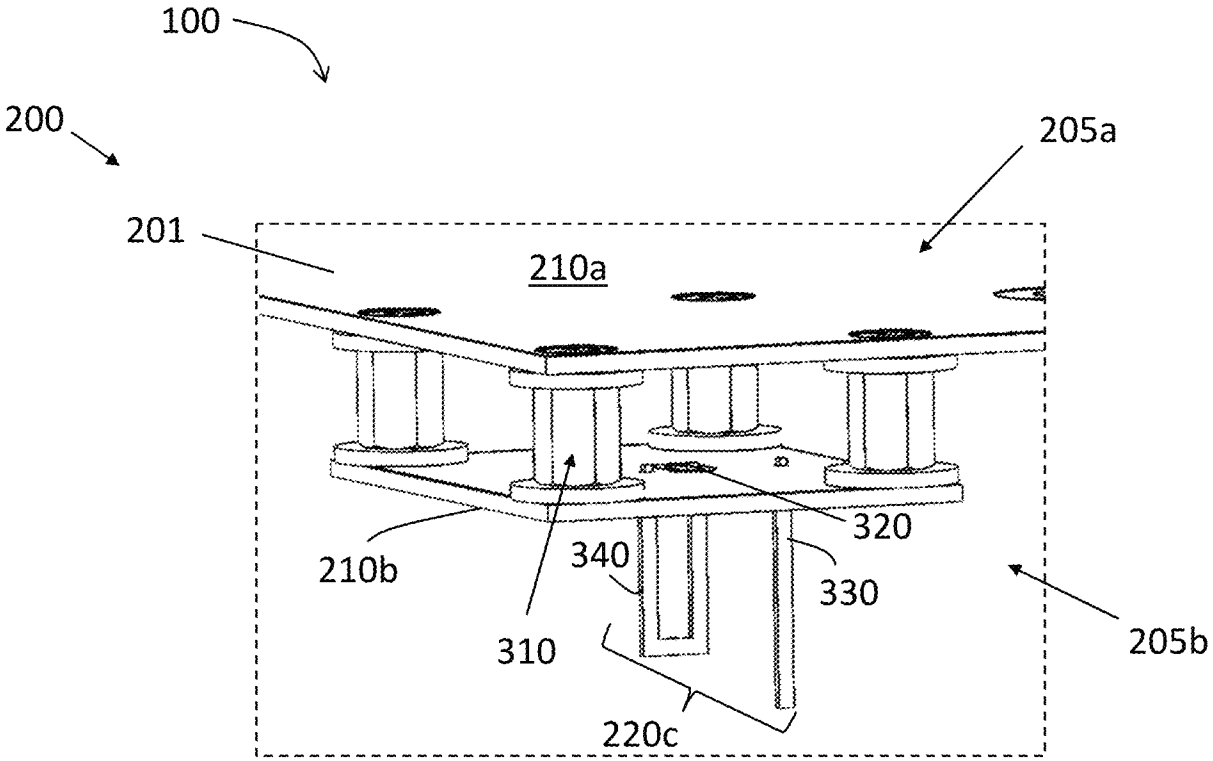
FIG. 3 details additional aspects of the exemplary multi-antenna ground plane structure for integration within a vehicle according to one or more embodiments.

The multi-antenna ground plane structure 200 is a multi-level structure and, in the exemplary embodiment shown in FIG. 2, includes two levels. On one level 205*a*, a ground plane 210*a* supports a GNSS antenna 220*a* and a satellite radio antenna 220*b* (generally referred to as antenna 220). A second level 205*b* (generally referred to as level 205) is detailed in FIG. 3 and includes a ground plane 210*b* (generally referred to as ground plane 210) that supports a V2X antenna 220*c*. As shown in FIGS. 2 and 3, the second ground plane 210*b* is affixed to the first ground plane 210*a* on a side 202 of the first ground plane 210*a* that is opposite the side 201 on which the antennas 220*a*, 220*b* are mounted. According to alternate embodiments, additional levels 205 may be added based on the volume 111 available.

The orientation, placement, and relative arrangement of the GNSS antenna 220*a* and satellite radio antenna 220*b* on the ground plane 210*a*, as well as the size and shape of the ground plane 210*a*, are used to control performance. The GNSS antenna 220*a* is shown on dielectric substrate 230*a* and the satellite radio antenna 220*b* is shown on a dielectric substrate 230*b* (generally referred to as dielectric substrate 230). Both the GNSS antenna 220*a* and the satellite radio antenna 220*b* benefit from a clear sky view. That is, the multi-antenna ground plane structure 200 is oriented within the volume 111 of the spoiler 110 such that the ground plane 210*a* on which the GNSS antenna 220*a* and the satellite radio antenna 220*b* are mounted faces away from the spoiler chassis 120 and toward an exterior of the vehicle 100.

The placement of the GNSS antenna 220*a* and the satellite radio antenna 220*b* on the ground plane 210*a* is such that the two antennas 220 are as far apart as possible while surrounded by as much ground plane 210*a* as possible on all sides (i.e., not on an edge) for their respective operating frequencies. Thus, the size and shape of the ground plane 210*a* is selected to facilitate this placement. As shown in FIG. 2, because the footprint of the GNSS antenna 220*a* (defined by the dielectric substrate 230*a*) is larger than that of the satellite radio antenna 220*b*, the ground plane 210*a* is shaped such that it is wider on an end on which the GNSS antenna 220*a* is mounted (i.e., the ground plane 210*a* has a non-uniform width over its length or its shape is non-uniform in one dimension along another, perpendicular, dimension). The size of the ground plane 210*a* is selected to facilitate separation of the two antennas 220 while also facilitating a fit within the volume 111 defined by the spoiler 110.

The relative arrangement of the GNSS antenna 220*a* and the satellite radio antenna 220*b* is such that the antennas 220 are not aligned (i.e., not parallel), as shown. The operating frequency of the L5 band of the GNSS antenna 220*a* is 1.176 gigahertz (GHz) while the operating frequency of the satellite radio antenna 220*b* may be on the order of 2.34 GHz. Thus, the second harmonic of the L5 band of the GNSS antenna 220*a* may interfere with the satellite radio antenna 220*b*. The relative arrangement of the antennas 220 facilitates isolation between the GNSS antenna 220*a* and the satellite radio antenna 220*b* without having to increase separation distance and, thus, the size of the ground plane 210*a*. In alternate embodiments, antennas 220 associated with other communication devices of the vehicle 100 may be mounted additionally or alternately on the ground plane

210*a*. The number of antennas 220 is limited by the space available within the volume 111 defined by the spoiler 110, which then limits the size of the ground plane 210*a*.

FIG. 3 details aspects of the multi-antenna ground plane structure 200 for integration within a vehicle 100 according to one or more embodiments. The second level 205*b* is detailed. As previously noted, the level 205*b* is affixed to the first level 205*a* on a second side 202 of the ground plane 210*a*. A V2X antenna 220*c* including a reflector 330 and folded monopole 340 is shown mounted on a ground plane 210*b* of the level 205*b*. The V2X antenna 220*c* is upside down relative to the orientation of the GNSS antenna 220*a* and satellite radio antenna 220*b* (on ground plane 210*a*). Standoff structures 310 (e.g., aluminum or other conductive posts) may be used to separate the two ground planes 210 while electrically connecting them. One end of the folded monopole 340 is connected to the ground plane 210*b* and the other end is an antenna feed point 320 which attaches the V2X antenna 220*c* to a coaxial cable (not shown). The ground plane 210*b* acts as a daughterboard of the ground plane 210*a*. The tiered structure of the levels 205 allows the dimensions of the multi-antenna ground plane structure 200 to fit within the volume 111 defined by the spoiler 110 while facilitate isolation of each of the antennas 220.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A multi-antenna ground plane structure in a vehicle, the multi-antenna ground plane structure comprising:

a first ground plane configured to be electrically connected to a fascia chassis, the fascia chassis being a portion of the vehicle covered by a fascia, wherein a first side of the first ground plane is configured to seat two or more antennas; and one or more additional ground planes affixed to a second side, opposite the first side, of the first ground plane, wherein one of the one or more additional ground planes is configured to be attached to one or more additional antennas such that the one or more additional antennas are oriented opposite an orientation of the two or more antennas seated on the first ground plane.

2. The multi-antenna ground plane structure according to claim 1, wherein the multi-antenna ground plane structure is shaped and sized to fit completely within a volume defined by the fascia.

3. The multi-antenna ground plane structure according to claim 1, wherein the fascia is a spoiler.

4. The multi-antenna ground plane structure according to claim 1, wherein the first ground plane is configured to be affixed to the fascia chassis.

5. The multi-antenna ground plane structure according to claim 1, wherein the first ground plane is configured to be electrically connected to the fascia chassis via copper tape.

6. The multi-antenna ground plane structure according to claim 1, wherein the two or more antennas include a global navigation satellite system (GNSS) antenna and a satellite radio antenna.

7. The multi-antenna ground plane structure according to claim 1, wherein the one or more additional antennas include a vehicle-to-everything (V2X) antenna.

8. The multi-antenna ground plane structure according to claim 1, wherein a shape of the first ground plane is non-uniform in a first dimension along a second dimension that is perpendicular to the first dimension.

9. The multi-antenna ground plane structure according to claim 1, wherein the one of the one or more additional ground planes is separated from the first ground plane by one or more standoff structures that electrically connect the first ground plane to the one of the one or more additional ground planes.

10. The multi-antenna ground plane structure according to claim 9, wherein the one or more standoff structures is an aluminum post.

11. A method of fabricating a multi-antenna ground plane structure, the method comprising:

fabricating a first ground plane to be electrically connected to a fascia chassis, the fascia chassis being a portion of the vehicle covered by a fascia, wherein a first side of the first ground plane is configured to seat two or more antennas; and affixing one or more additional ground planes to a second side, opposite the first side, of the first ground plane, wherein one of the one or more additional ground planes is configured to be attached to one or more additional antennas such that the one or more additional antennas are oriented opposite an orientation of the two or more antennas seated on the first ground plane.

12. The method according to claim 11, wherein the fabricating includes shaping and sizing the multi-antenna ground plane structure to fit completely within a volume defined by the fascia.

13. The method according to claim 11, wherein the fascia is a spoiler.

14. The method according to claim 11, wherein the fabricating includes configuring the first ground plane to be affixed to the fascia chassis.

15. The method according to claim 11, wherein the fabricating includes configuring the first ground plane to be electrically connected to the fascia chassis via copper tape.

16. The method according to claim 11, wherein the seating the two or more antennas includes seating a global navigation satellite system (GNSS) antenna and a satellite radio antenna.

17. The method according to claim 11, wherein the attaching the one of the one or more additional ground planes to the one or more additional antennas includes attaching the one of the one or more additional ground planes to a vehicle-to-everything (V2X) antenna.

18. The method according to claim 11, wherein the fabricating includes shaping the first ground plane to be non-uniform in a first dimension along a second dimension that is perpendicular to the first dimension.

19. The method according to claim 11, further comprising separating the one of the one or more additional ground planes from the first ground plane using one or more standoff structures that electrically connect the first ground plane to the one of the one or more additional ground planes.

20. The method according to claim 19, wherein the one or more standoff structures is an aluminum post.

* * * * *